US006460985B1

(12) United States Patent
Olsen et al.

(10) Patent No.: US 6,460,985 B1
(45) **Date of Patent: *Oct. 8, 2002**

(54) INK RESERVOIR FOR AN INKJET PRINTER

(75) Inventors: David Olsen, Corvallis, OR (US); David C Johnson, Portland, OR (US); Jeffrey K Pew, Oswego, OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/430,400

(22) Filed: Oct. 29, 1999

(51) Int. Cl.[7] ..... B41J 2/175
(52) U.S. Cl. ..... 347/86
(58) Field of Search ..... 347/84, 85, 86, 347/87; 428/373

(56) References Cited

U.S. PATENT DOCUMENTS

| | | | | |
|---|---|---|---|---|
| 4,286,005 A | | 8/1981 | Berger | 428/167 |
| 4,771,295 A | | 9/1988 | Baker et al. | 347/87 |
| 4,794,409 A | | 12/1988 | Cowger et al. | 347/87 |
| 5,124,205 A | | 6/1992 | Raynolds et al. | 428/364 |
| 5,169,467 A | | 12/1992 | Komiya et al. | 156/180 |
| 5,182,581 A | | 1/1993 | Kashimura et al. | 347/87 |
| 5,607,766 A | * | 3/1997 | Berger | 428/373 |
| 5,619,237 A | | 4/1997 | Inoue et al. | 347/86 |
| 5,620,641 A | | 4/1997 | Berger | 264/103 |
| 5,621,446 A | | 4/1997 | Tanaka et al. | 347/85 |
| 5,657,065 A | | 8/1997 | Lin | 347/93 |
| 5,784,088 A | | 7/1998 | Ujita et al. | 347/86 |

FOREIGN PATENT DOCUMENTS

| | | | | |
|---|---|---|---|---|
| EP | 0562733 A | | 9/1993 | |
| EP | 0756935 A | | 2/1997 | |
| EP | 0894630 A | | 2/1999 | |
| JP | 406255121 A | * | 9/1994 | B41J/2/175 |
| JP | 0691207 A2 | * | 10/1996 | B41J/2/175 |

* cited by examiner

*Primary Examiner*—Anh T. N. Vo
(74) *Attorney, Agent, or Firm*—Kevin B. Sullivan

(57) ABSTRACT

The present disclosure relates to an ink container for providing ink to an inkjet printhead. The ink container includes a reservoir for containing ink. Also included in the ink container is at least one continuous fiber defining a three dimensional porous member. The at least one continuous fiber is bonded to itself at points of contact to form a self-sustaining structure that is disposed within the reservoir for retaining ink. Ink is drawn from the self-sustaining structure and provided to the inkjet printhead.

42 Claims, 6 Drawing Sheets

INK RESERVOIR FOR AN INKJET PRINTER

BACKGROUND OF THE INVENTION

The present invention relates to ink containers for providing ink to inkjet printers. More specifically, the present invention relates to ink containers that make use of a network of heat bonded fibers for retaining and providing the controlled release of ink from the ink container.

Inkjet printers frequently make use of an inkjet printhead mounted within a carriage that is moved back and forth across print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system not to move with the carriage.

For the case where the ink supply is not carried with the carriage, the ink supply can be in continuous fluid communication with the printhead by the use of a conduit to replenish the printhead continuously. Alternatively, the printhead can be intermittently connected with the ink supply by positioning the printhead proximate to a filling station that facilitates connection of the printhead to the ink supply.

For the case where the ink supply is carried with the carriage, ink supply may be integral with the printhead, whereupon the entire printhead and ink supply is replaced when ink is exhausted. Alternatively, the ink supply can be carried with the carriage and be separately replaceable from the printhead. For the case where the ink supply is separately replaceable, the ink supply is replaced when exhausted, and the printhead is replaced at the end of printhead life. Regardless of where the ink supply is located within the printing system, it is critical that the ink supply provide a reliable supply of ink to the inkjet printhead.

In addition to providing ink to the inkjet printhead, the ink supply frequently provides additional functions within the printing system, such as maintaining a negative pressure, frequently referred to as a backpressure, within the ink supply and inkjet printhead. This negative pressure must be sufficient so that a head pressure associated with the ink supply is kept at a value that is lower than the atmospheric pressure to prevent leakage of ink from either the ink supply or the inkjet printhead frequently referred to as drooling. The ink supply is required to provide a negative pressure or back pressure over a wide range of temperatures and atmospheric pressures in which the inkjet printer experiences in storage and operation.

One negative pressure generating mechanism that has previously been used is a porous member, such as an ink absorbing member, which generates a capillary force. Once such ink absorbing member is a reticulated polyurethane foam which is discussed in U.S. Pat. No. 4,771,295, entitled "Thermal Inkjet Pen Body Construction Having Improved Ink Storage and Feed Capability" to Baker, et al., issued Sep. 13, 1988, and assigned to the assignee of the present invention.

There is an ever present need for ink supplies which make use of low cost materials and are relatively easy to manufacture, thereby reducing ink supply cost that tends to reduce the per page printing costs. In addition, these ink containers should be volumetricly efficient to produce a relative compact ink supply for reducing the overall size of the printing system. In addition, these ink supplies should be capable of being made in different form factors so that the size of the printing system can be optimized. Finally, these ink supplies should be compatible with inks used in inkjet printing systems to prevent contamination of these inks. Contamination of the ink tends to reduce the life of the inkjet printhead as well as reduce the print quality.

SUMMARY OF THE INVENTION

One aspect of the present invention is an ink container for providing ink to an inkjet printhead. The ink container includes a reservoir for containing ink. Also included in the ink container is at least one continuous fiber defining a three dimensional porous member. The at least one continuous fiber is bonded to itself at points of contact to form a self-sustaining structure that is disposed within the reservoir for retaining ink. Ink is drawn from the self-sustaining structure and provided to the inkjet printhead.

In a preferred embodiment, the present invention the at least one continuous fiber is a bi-component fiber having a core material and a sheath material at least partially surrounding the core material. In this preferred embodiment the core material is polypropylene and the sheath material is polyethylene terephthalate. The at least one continuous fiber is preferably bonded to itself by heat that softens the fiber to bond to itself.

DETAILED DESCRIPTION OF THE PREFERRED EMBODIMENT

Figure 1:
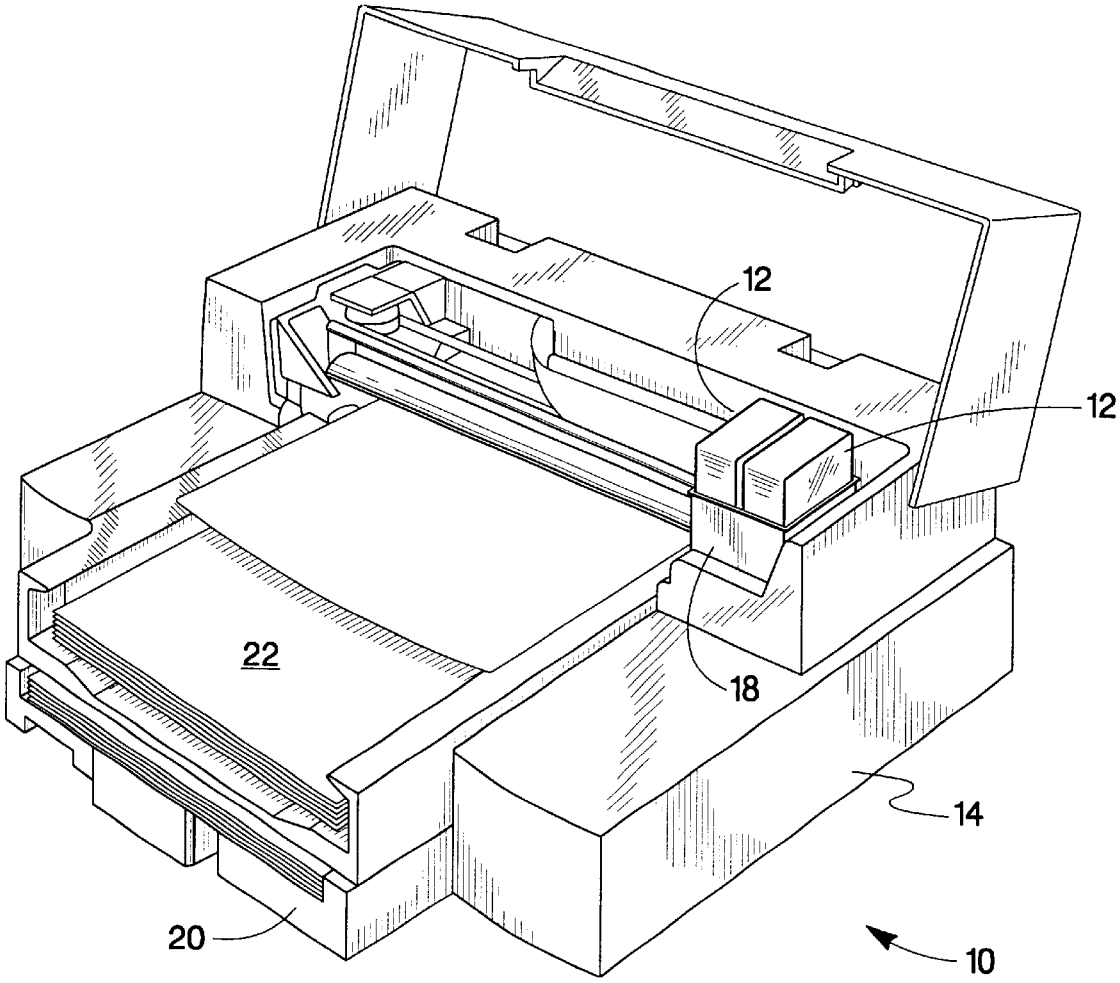
FIG. 1 is an exemplary embodiment of an inkjet printer that incorporates the ink container of the present invention.

FIG. 1 is a perspective view of one exemplary embodiment of a printing system 10, shown with its cover open, that includes at least one ink container 12 of the present invention. The printing system 10 further includes at least one inkjet printhead (not shown) installed in the printer portion 14. The inkjet printhead is responsive to activation signal from the printer portion 14 to eject ink. The inkjet printhead is replenished with ink by the ink container 12.

The inkjet printhead is preferably installed in a scanning carriage 18 and moved relative to a print media as shown in FIG. 1. Alternatively, the inkjet printhead is fixed and the print media is moved past the printhead to accomplish printing. The inkjet printer portion 14 includes a media tray 20 for receiving print media 22. As print media 22 is stepped through the print zone, the scanning carriage moves the printhead relative to the print media 22. The printer portion 14 selectively activates the printhead to deposit ink on print media to thereby accomplish printing.

The printing system 10 shown in FIG. 1 is shown with 2 replaceable ink containers 12 representing an ink container 12 for black ink and a three-color partitioned ink container 12 containing cyan, magenta, and yellow inks, allowing for printing with four colorants. The method and apparatus of the present invention is applicable to printing systems 10 that make use of other arrangements such as printing systems that use greater or less than 4-ink colors, such as in high fidelity printing which typically uses 6 or more colors.

Figure 2:
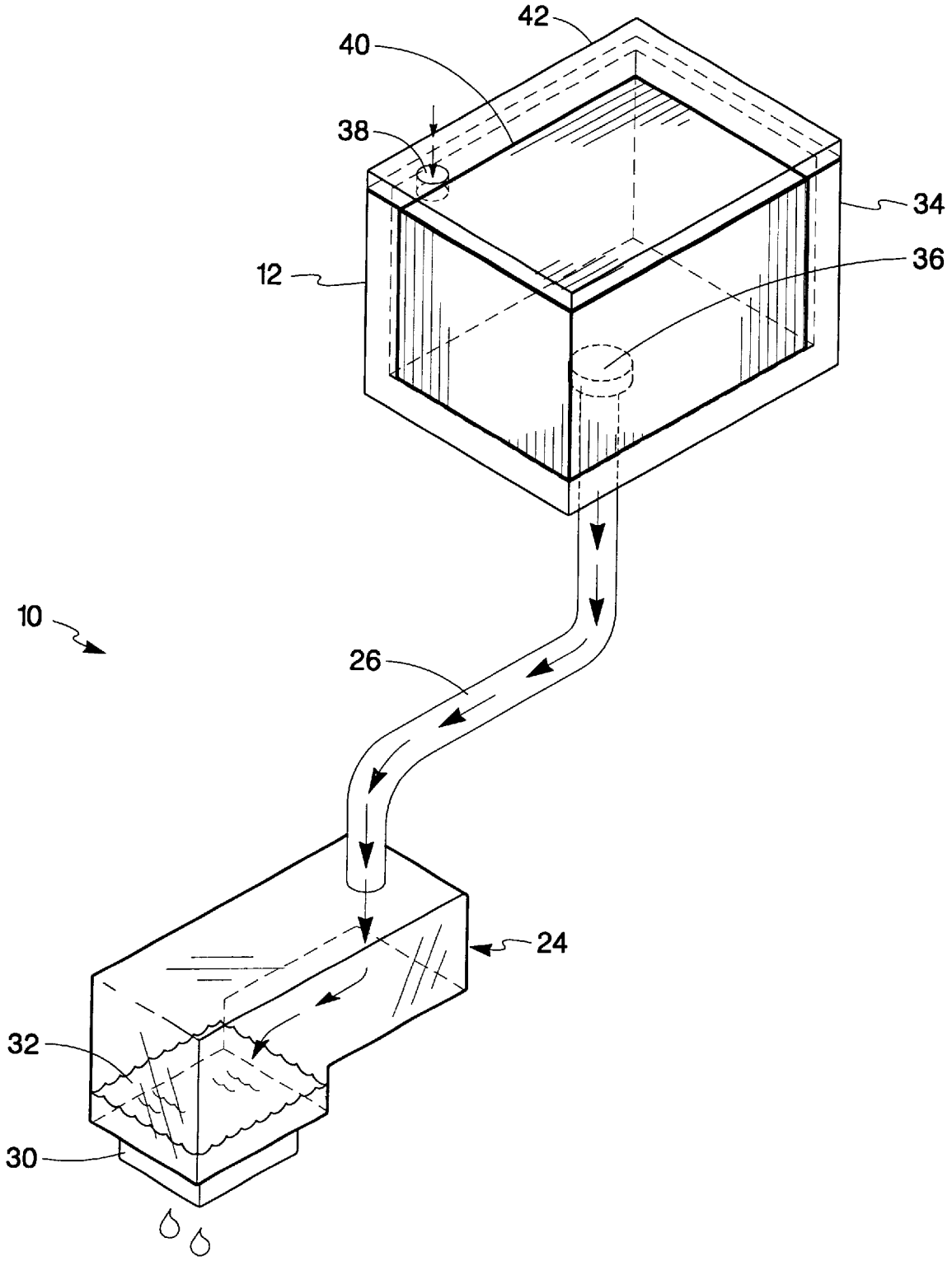
FIG. 2 is a schematic representation of the ink container of the present invention and an inkjet printhead that receives ink from the ink container to accomplish printing.

FIG. 2 is a schematic representation of the printing system 10 which includes the ink supply or ink container 12, an inkjet printhead 24, and a fluid interconnect 26 for fluidically interconnecting the ink container 12 and the printhead 24.

The printhead 24 includes a housing 28 and an ink ejection portion 30. The ink ejection portion 30 is responsive to activation signals by the printer portion 14 for ejecting ink to accomplish printing. The housing 28 defines a small ink reservoir for containing ink 32 that is used by the ejection portion 30 for ejecting ink. As the inkjet printhead 24 ejects ink or depletes the ink 32 stored in the housing 28, the ink container 12 replenishes the printhead 24. A volume of ink contained in the ink supply 12 is typically significantly larger than a volume of ink container within the housing 28. Therefore, the ink container 12 is a primary supply of ink for the printhead 24.

The ink container 12 includes a reservoir 34 having a fluid outlet 36 and an air inlet 38. Disposed within the reservoir 34 is a network of fibers that are heat fused at points of contact to define a capillary storage member 40. The capillary storage member 40 performs several important functions within the inkjet printing system 10. The capillary storage member 40 must have sufficient capillarity to retain ink to prevent ink leakage from the reservoir 34 during insertion and removal of the ink container 12 from the printing system 10. This capillary force must be sufficiently great to prevent ink leakage from the ink reservoir 34 over a wide variety of environmental conditions such as temperature and pressure changes. The capillary should be sufficient to retain ink within the ink container 12 for all orientations of the reservoir 34 as well as undergoing shock and vibration that the ink container 12 may undergo during handling.

Once the ink container 12 is installed into the printing system 10 and fluidically coupled to the printhead by way of fluid interconnect 26, the capillary storage member 40 should allow ink to flow from the ink container 12 to the inkjet printhead 24. As the inkjet printhead 24 ejects ink from the ejection portion 30, a negative gauge pressure, sometimes referred to as a back pressure, is created in the printhead 24. This negative gauge pressure within the printhead 24 should be sufficient to overcome the capillary force retaining ink within the capillary member 40, thereby allowing ink to flow from the ink container 12 into the printhead 24 until equilibrium is reached. Once equilibrium is reached and the gauge pressure within the printhead 24 is equal to the capillary force retaining ink within the ink container 12, ink no longer flows from the ink container 12 to the printhead 24. The gauge pressure in the printhead 24 will generally depend on the rate of ink ejection from the ink ejection portion 30. As the printing rate or ink ejection rate increases, the gauge pressure within the printhead will become more negative causing ink to flow at a higher rate to the printhead 24 from the ink container 12. In one preferred inkjet printing system 10 the printhead 24 produces a maximum backpressure that is equal to 10 inches of water or a negative gauge pressure that is equal to 10 inches of water.

The printhead 24 can have a regulation device included therein for compensation for environmental changes such as temperature and pressure variations. If these variations are not compensated for, then uncontrolled leaking of ink from the printhead ejection portion 30 can occur. In some configurations of the printing system 10 the printhead 24 does not include a regulation device, instead the capillary member 40 is used to maintain a negative back pressure in the printhead 24 over normal pressure and temperature excursions. The capillary force of the capillary member 40 tends to pull ink back to the capillary member, thereby creating a slight negative back pressure within the printhead 24. This slightly negative back pressure tends to prevent ink from leaking or drooling from the ejection portion 30 during changes in atmospheric conditions such as pressure changes and temperature changes. The capillary member 40 should provide sufficient back pressure or negative gauge pressure in the printhead 24 to prevent drooling during normal storage and operating conditions.

The embodiment in FIG. 2 depicts an ink container 12 and a printhead 24 that are each separately replaceable. The ink container 12 is replaced when exhausted and the printhead 24 is replaced at end of life. The method and apparatus of the present invention is applicable to inkjet printing systems 10 having other configurations than those shown in FIG. 2. For example, the ink container 12 and the printhead 24 can be integrated into a single print cartridge. The print cartridge which includes the ink container 12 and the printhead 24 is then replaced when ink within the cartridge is exhausted.

The ink container 12 and printhead 24 shown in FIG. 2 contain a single color ink. Alternatively, the ink container 12 can be partitioned into three separate chambers with each chamber containing a different color ink. In this case, three printheads 24 are required with each printhead in fluid communication with a different chamber within the ink container 12. Other configurations are also possible, such as more or less chambers associated with the ink container 12 as well as partitioning the printhead and providing separate ink colors to different partitions of the printhead or ejection portion 30.

Figure 3:
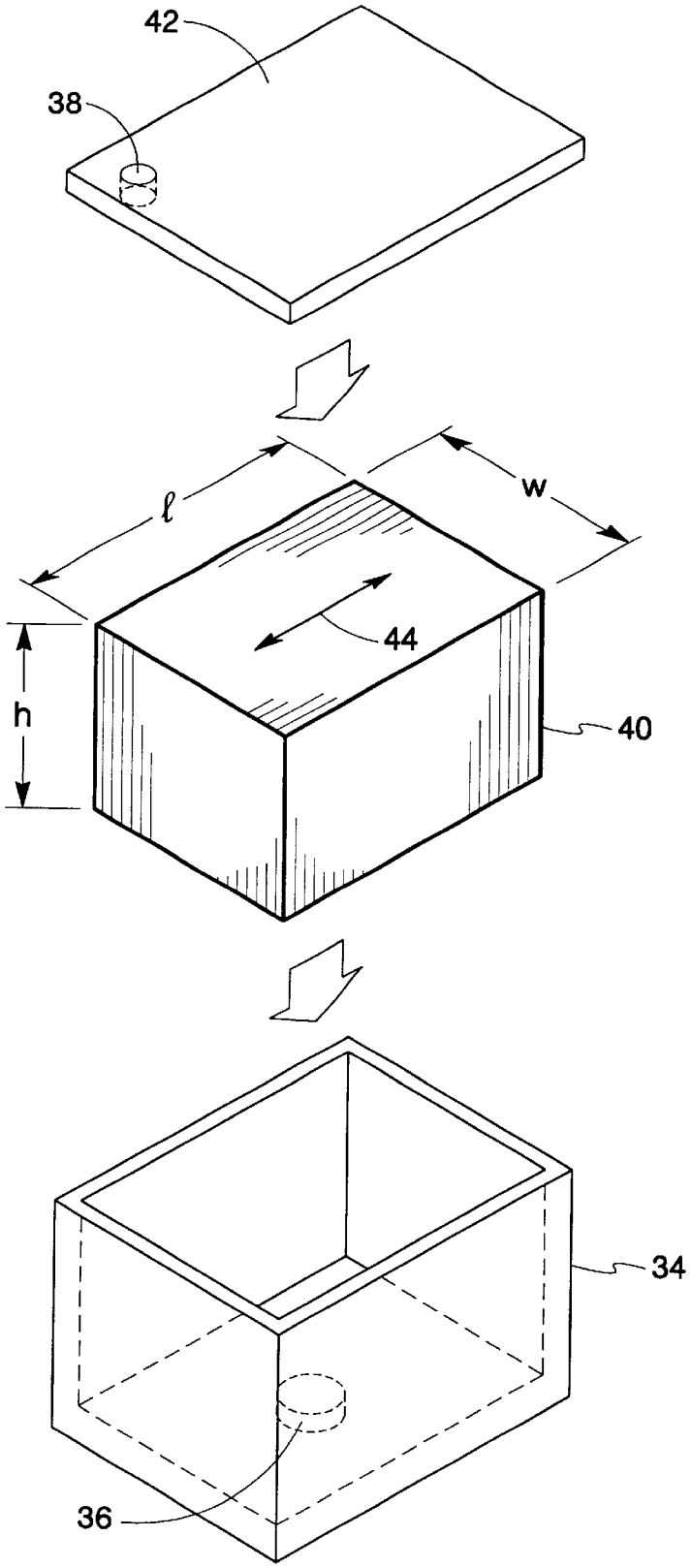
FIG. 3 is an exploded view of the ink container of the present invention showing an ink reservoir, a network of fused fibers for insertion into the reservoir, and a reservoir cover for enclosing the reservoir.

FIG. 3 is an exploded view of the ink container 12 shown in FIG. 2. The ink container 12 includes an ink reservoir portion 34, the capillary member 40 and a lid 42 having an air inlet 38 for allowing entry of air into the ink reservoir 34. The capillary member 40 is inserted into the ink reservoir 34. The reservoir 34 is filled with ink as will be discussed in more detail with respect to FIG. 7, and the lid 42 is placed on the ink reservoir 34 to seal the reservoir. In the preferred embodiment, each of the height, width, and length dimensions indicated by H, W, and L, respectively are all greater than one inch to provide a high capacity ink container 12.

In the preferred embodiment, the capillary member 40 of the present invention is formed from a network of fibers that are heat fused at points of contact. These fibers are preferably formed of a bi-component fiber having a sheath formed of polyester such as polyethylene terephthalate (PET) or a co-polymer thereof and a core material that is formed of a low cost, low shrinkage, high strength thermoplastic polymer, preferably polypropylene or polybutylene terephthalate.

The network of fibers are preferably formed using a melt blown fiber process. For such a melt blow fiber process, it may be desirable to select a core material of a melt index similar to the melt index of the sheath polymer. Using such a melt blown fiber process, the main requirement of the core material is that it is crystallized when extruded or crystallizable during the melt blowing process. Therefore, other highly crystalline thermoplastic polymers such as high density polyethylene terephthalate, as well as polyamides such as nylon and nylon 66 can also be used. Polypropylene is a preferred core material due to its low price and ease of processibility. In addition, the use of a polypropylene core material provides core strength allowing the production of fine fibers using various melt blowing techniques. The core material should be capable of forming a bond to the sheath material as well.

Figure 4A:
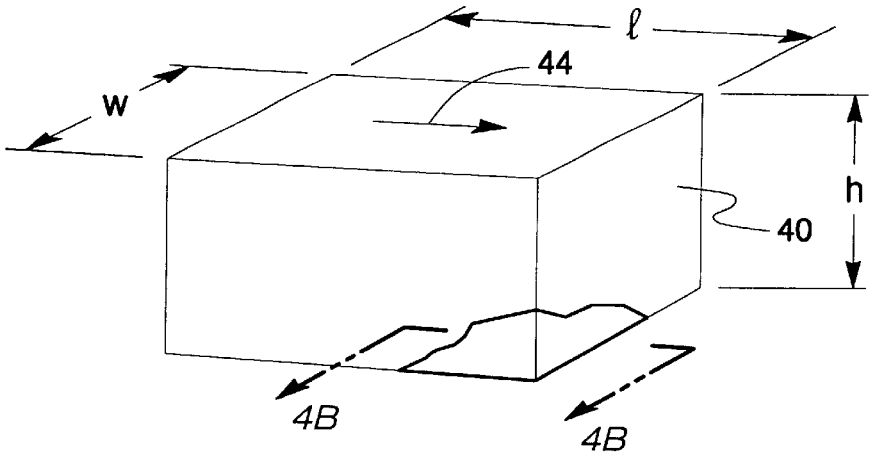
FIG. 4A is represents the network of fused fibers shown in FIG. 3.
Figure 4B:
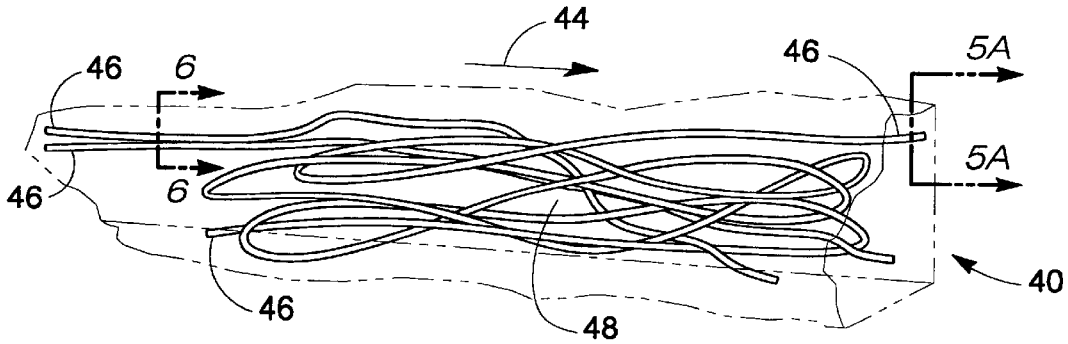
FIG. 4B is a greatly enlarged perspective view taken across lines 4B—4B of the network of fused fibers shown in FIG. 4A that are inserted into the ink reservoir shown in FIG. 3.

FIG. 4B is a greatly simplified representation of the network of fibers which form the capillary member 40, shown greatly enlarged in break away taken across lines 4A—4A of the capillary member 40 shown in FIG. 4A. The capillary member 40 is made up of a network of fibers with each individual fiber 46 being heat bonded or heat fused to other fibers at points of contact. The network of fibers 46 which make up the capillary member 40 can be formed of a single fiber 46 that is wrapped back upon itself, or formed of a plurality of fibers 46. The network of fibers form a self-sustaining structure having a general fiber orientation represented by arrow 44. The self-sustaining structure defined by the network of fibers 46 defines spacings or gaps between the fibers 46 which form a tortuous interstitial path. This interstitial path is formed to have excellent capillary properties for retaining ink within the capillary member 40.

In one preferred embodiment, the capillary member 40 is formed using a melt blowing process whereby the individual fibers 46 are heat bonded or melt together to fuse at various points of contact throughout the network of fibers. This network of fibers, when fed through a die and cooled, hardens to form a self-sustaining three dimensional structure.

Figure 5A:
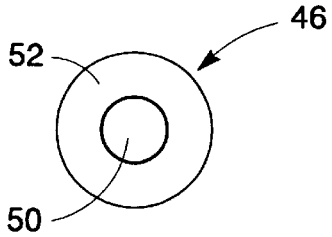
FIG. 5A is a cross section of a single fiber taken across lines 5—5 of FIG. 4.

FIG. 5A represents a cross section taken across lines 5A—5A in FIG. 4 to illustrate a cross section of an individual fiber 46. Each individual fiber 46 is a bi-component fiber, having a core 50 and a sheath 52. The size of the fiber 46 and relative portion of the sheath 52 and core 50 have been greatly exaggerated for illustrative clarity. The core material preferably comprises at least 30 percent and up to 90 percent by weight of the overall fiber content. In the preferred embodiment, each individual fiber 46 has, on average, a diameter of 12 microns or less.

Figure 5B:
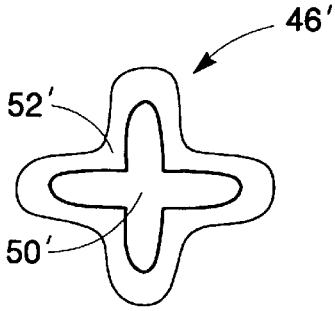
FIG. 5B is an alternative embodiment of a fiber shown in FIG. 4 having a cross-shaped or x-shaped core portion.

FIG. 5B represents an alternative fiber 46 that is similar to the fiber 46 shown in FIG. 5A, except fiber 46 in FIG. 5B has a cross or x-shaped cross section instead of a circular cross section. The fiber 46 shown in FIG. 5B has a non-round or cross-shaped core 50 and a sheath 52 that completely cover the core material 50. Various other alternative cross sections can also be used, such as a tri-lobal or y-shaped fiber, or an h-shaped cross-section fiber, just to name a few. The use of non-round fibers results in an increased surface area at the fibrous surface. The capillary pressure and absorbency of the network of fibers 40 is increased in direct proportion to the wettable fiber surface. Therefore, the use of nonround fibers tends to improve the capillary pressure and absorbency of the capillary member 40.

Another method for improving the capillary pressure and absorbency is to reduce a diameter of the fiber 46. With a constant fiber bulk density or weight, the use of smaller fibers 46 improves the surface area of the fiber. Smaller fibers 46 tend to provide a more uniform retention. Therefore, by changing the diameter of the fiber 46 as well as by changing the shape of the fiber 46, the desired capillary pressure for the printing system 10 can be achieved.

Figure 6:
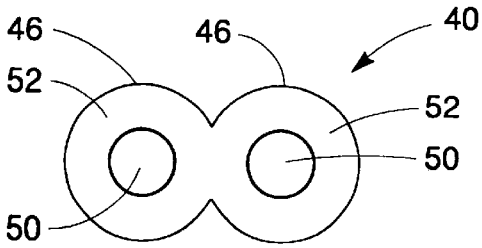
FIG. 6 is a cross section of a pair of fibers that are fused at a contact point taken across lines 6—6 shown in FIG. 4.

FIG. 6 illustrates the heat melding or heat fusing of individual fibers 46. FIG. 6 is a cross section taken across lines 66 at a point of contact between two individual fibers. Each individual fiber 46 has a core 50 and a sheath 52. At a point of contact between the two fibers 46, the sheath material 52 is melted together or fused with the sheath material of the adjacent fiber 46. The fusing of individual fibers is accomplished without the use of adhesives or binding agents. Furthermore, individual fibers 46 are held together without requiring any retaining means, thereby forming a self-sustaining structure.

Figure 7:
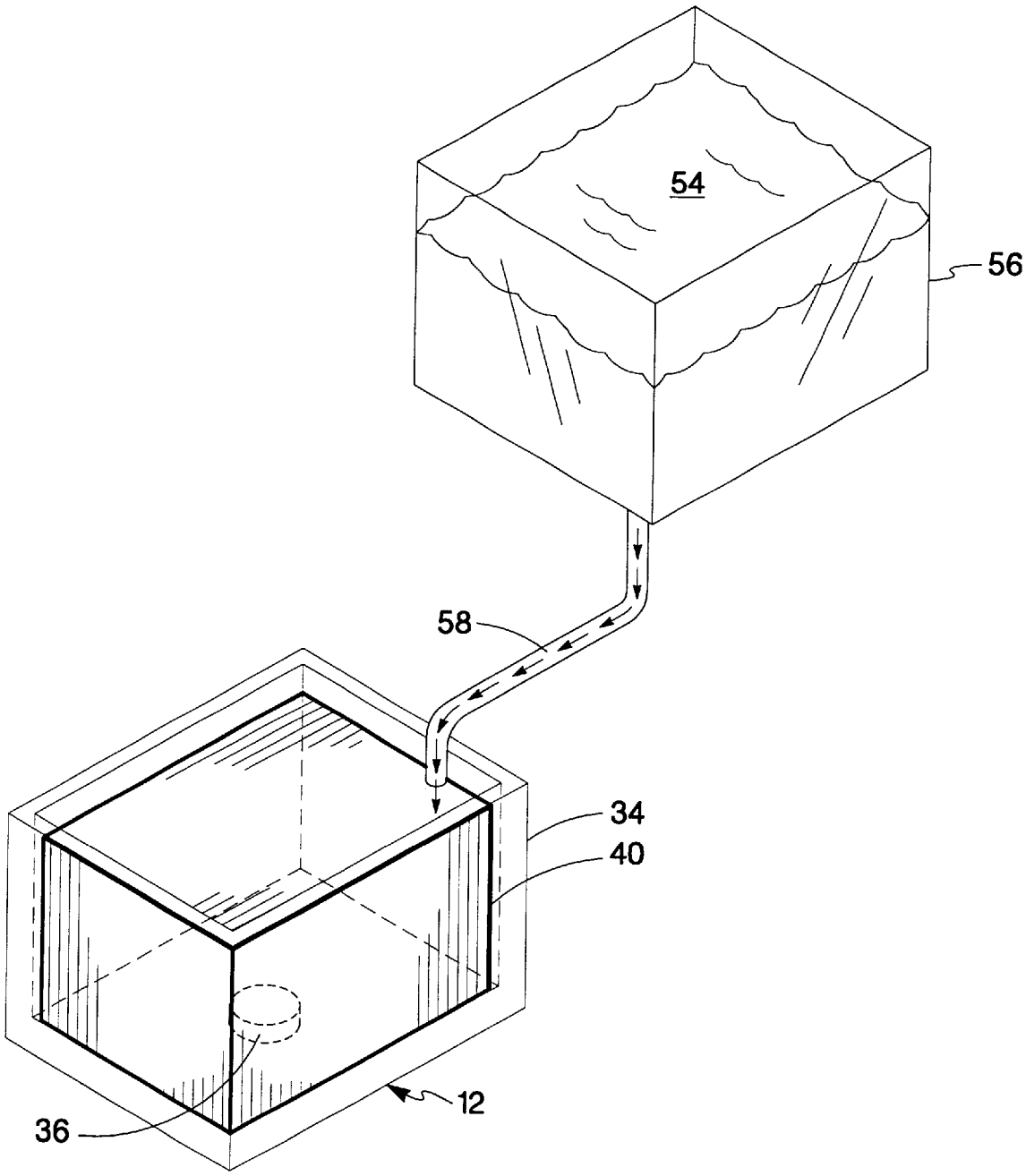
FIG. 7 is a simplified representation of the method of the present invention for filling the ink supply shown in FIG. 3.

FIG. 7 is a schematic illustration of the process of filling ink into the ink container 12 of the present invention. The ink container 12 is shown with the capillary member 40 inserted into the reservoir 34. The lid 42 is shown removed. Ink is provided to the reservoir 34 by an ink container 54 having a supply of ink 56 contained therein. A fluid conduit 58 allows ink to flow from the ink supply 54 into the reservoir 34. As ink flows into the reservoir, ink is drawn into the interstitial spaces 48 between fibers 46 of the network of fibers 40 by the capillarity of this network of fibers. Once the capillary member 40 is no longer capable of absorbing ink, the flow of ink from the ink container 54 is ceased. The lid 42 is then placed on the ink reservoir 34.

Although the method of filling the ink reservoir 34 accomplished without the lid 42 as shown in FIG. 7, the reservoir 34 can be filled in other ways as well. For example the reservoir can alternatively be filled with the lid 42 in place, and ink is provided from the ink supply 54 through the air vent from the lid 42 and into the reservoir. Alternatively, the reservoir 34 can be inverted, and ink can be filled from the ink supply 54 through the fluid outlet 36 and into the ink reservoir 34. Once in the reservoir 34, ink is absorbed by the capillary member 40. The method of the present invention can be used during the initial filling of the ink reservoir 34 at the time of manufacture as a method to refill the ink container 12 once ink is exhausted.

The use of the capillary material 40 of the present invention which is preferably a bi-component fiber having polypropylene core and a polyethylene terephthalate sheath greatly simplifies the process of filling the ink container. The capillary material 40 of the present invention is more hydrophilic than the polyurethane foam that has been used previously as an absorbent material in thermal inkjet pens such as those disclosed in U.S. Pat. No. 4,771,295, to Baker, et al., entitled "Thermal Inkjet Pen Body Construction Having Improved Ink Storage and Feed Capability" issued Sep. 13, 1988, and assigned to the assignee of the present invention. Polyurethane foam, in its untreated state, has a large ink contact angle, therefore making it difficult to fill ink containers having polyurethane foam contained therein without using expensive and time consuming steps such as vacuum filling in order to wet the foam. Polyurethane foam can be treated to improve or reduce the ink contact angle; however, this treatment, in addition to increasing manufacturing cost and complexity, tends to add impurities into the ink which tend to reduce printhead life or reduce printhead quality. The use of the capillary member 40 of the present invention has a relatively low ink contact angle, allowing ink to be readily absorbed into the capillary member 40 without requiring treatment of the capillary member 40.

Figure 8:
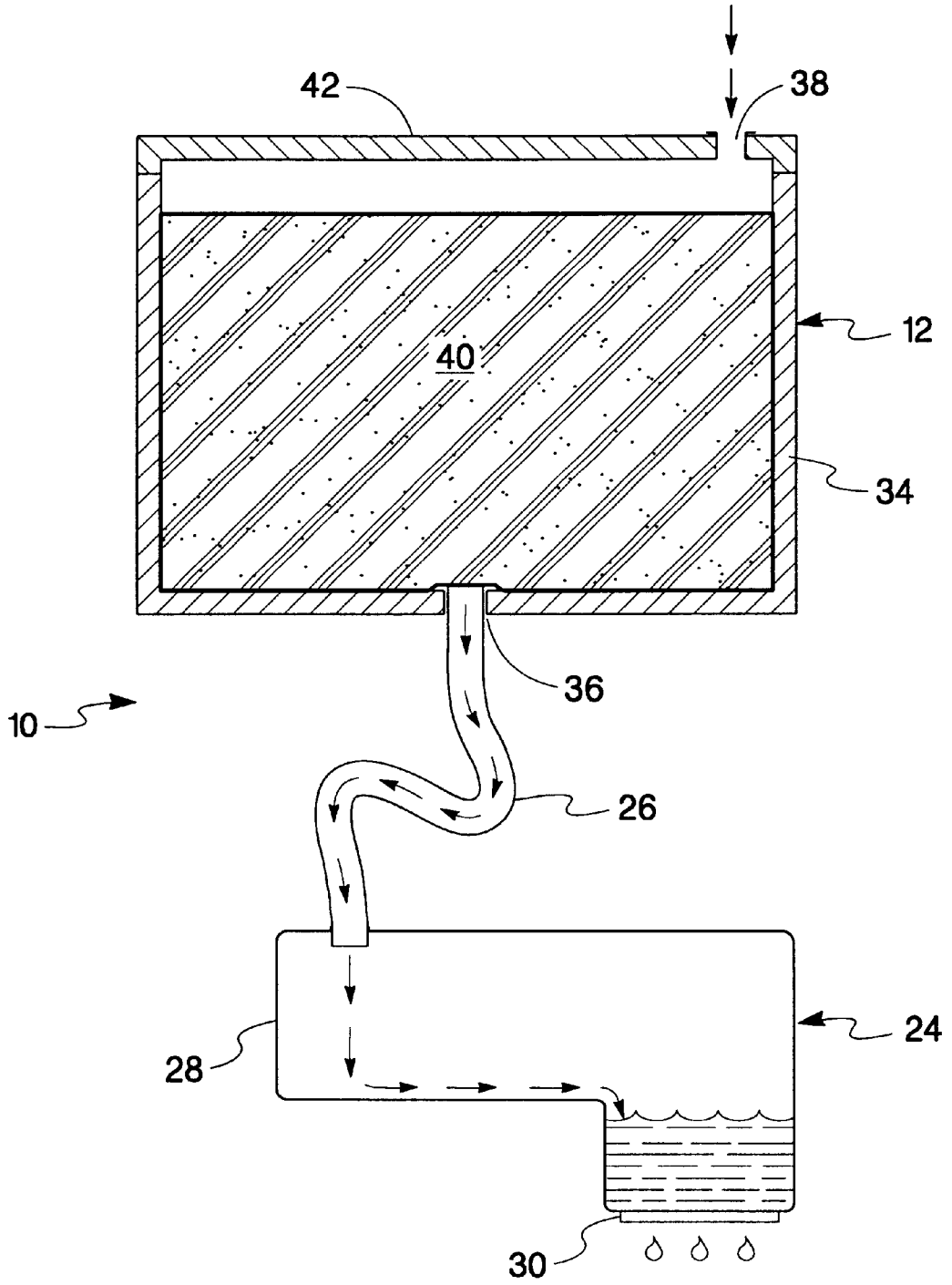
FIG. 8 is a schematic representation of the ink container shown in FIG. 3 fluidically coupled to an inkjet printhead.

FIG. 8 shows inkjet printing system 10 of the present invention in operation. With the ink container 12 of the present invention properly installed into the inkjet printing system 10, fluidic coupling is established between the ink container 12 and the inkjet printhead 24 by way of a fluid conduit 26. The selective activation of the drop ejection portion 30 to eject ink produces a negative gauge pressure within the inkjet printhead 24. This negative gauge pressure draws ink retained in the interstitial spaces between fibers 46 within the capillary storage member 40. Ink that is provided by the ink container 12 to the inkjet printhead 24 replenishes the inkjet printhead 24. As ink leaves the reservoir through fluid outlet 36, air enters through a vent hole 38 to replace a volume of ink and exits the reservoir 34, thereby preventing the build up of a negative pressure or negative gauge pressure within the reservoir 34.

The ink container 12 of the present invention makes use of a relatively low cost bi-component fiber 46 that is preferably comprised of a polypropylene core and a polyethylene terephthalate sheath. Individual fibers are heat bonded at points of contact to form a free standing structure having good capillarity properties. The fiber 46 material is chosen to be naturally hydrophilic to inkjet inks. The particular fiber 46 material is chosen to have a surface energy that is greater than a surface tension of the inkjet inks. The use of a naturally hydrophilic capillary storage member 40 allows faster ink filling of the reservoir 34 without requiring special vacuum filling techniques frequently used in less hydrophilic materials such as polyurethane foam. Materials that are less hydrophilic often require surfactants to be added to the ink or treatment of the capillary storage member to improve wettability or hydrophilicity. The surfactants tend to alter the ink composition from its optimum composition.

In addition, the fiber 46 material selected for the capillary storage member 40 are less reactive to inkjet inks than other materials frequently used in this application. In the case where ink components react to the capillary storage member, the ink that is initially put into the foam is different from the ink that is removed from the foam to replenish the printhead 24. This contamination to the ink tends to result in reduced printhead life and lower print quality.

Finally, the capillary storage member of the present invention makes use of extrusion polymers that have lower manufacturing costs than foam type reservoirs. In addition, these extrusion polymers tend to be more environmentally friendly and consume less energy to manufacture than the previously used foam type storage members.

What is claimed is:

1. An ink container for providing ink to an inkjet printhead, the ink container comprising:

a reservoir for containing the ink, the ink container when inserted into a printing system having a top and a bottom relative to a gravitational frame of reference, the ink container further including a fluid outlet proximate the bottom of the ink container for permitting ink flow from the reservoir to the printhead, the reservoir having a rectangular configuration with a height dimension, a width dimension and a length dimension, and wherein each of said dimensions is greater than one inch; and an ink absorbing member having a rectangular configuration, said member disposed in said reservoir for generating a capillary force on the ink in the reservoir, said ink absorbing member including at least one continuous fiber defining a three dimensional porous member with the at least one continuous fiber bonded to itself at points of contact to form a self sustaining structure for retaining the ink and is disposed within the reservoir, wherein ink drawn from the self sustaining structure is provided to the inkjet printhead, said ink absorbing member having a general fiber orientation in a direction parallel to said bottom of said reservoir.

2. The ink container of claim 1 wherein the at least one continuous fiber is a bi-component fiber having a core material and a sheath material at least partially surrounding the core material with the sheath material different from the core material.

3. The ink container of claim 2 wherein the sheath material has a higher melting temperature than the core material.

4. The ink container of claim 2 wherein the core material is polypropylene.

5. The ink container of claim 1 wherein the at least one continuous fiber is a plurality of fibers that are bonded to each other.

6. The ink container of claim 1 wherein the at least one continuous fiber is bonded to itself by heat that softens the fiber to bond to itself.

7. The ink container of claim 1 wherein the at least one continuous fiber defies intercommunicating interstitial spaces capable of holding a quantity of said ink.

8. The ink container of claim 1 wherein the at least one continuous fiber is formed from a thermoplastic polymer material consisting of polyethylene terephthalate and copolymers thereof.

9. The ink container of claim 1 wherein the ink container is removable from said system separate from said printhead.

10. The ink container of claim 1, wherein said fiber has a diameter which sets a desired capillary pressure for the inkjet printhead.

11. The ink container of claim 1 wherein said fiber is fabricated of a fiber material which is naturally hydrophilic to the ink.

12. A primary ink storage device for providing ink to an inkjet printhead, the primary ink storage device comprising:

a reservoir for containing ink, the reservoir having a fluid outlet therein, the ink container when inserted into a printing system having a top and a bottom relative to a gravitational frame of reference, the ink container further including a fluid outlet proximate the bottom of the ink container for permitting ink flow from the reservoir to the printhead, the reservoir having a rectangular configuration with a height dimension, a width dimension and a length dimension, and wherein each of said dimensions is greater than one inch; and a network of fibers disposed within the reservoir to retain ink, the network of fibers being heat fused to each other to define a rectangular, self-sustaining capillary storage member for storing ink within the reservoir wherein ink drawn from the network of fibers is provided to the inkjet printhead, the capillary storage member having a rectangular configuration with a height dimension, a width dimension and a length dimension, and wherein each of said dimensions is greater than one inch, said network of fibers having a general fiber orientation in a direction parallel to said bottom of said container.

13. The primary ink storage device of claim 12 wherein the network of fibers including at least one fiber that is a bi-component fiber having a core material and a sheath material at least partially surrounding the core material with the sheath material different from the core material.

14. The primary ink storage device of claim 13 wherein the sheath material has a higher melting temperature than the core material.

15. The primary ink storage device of claim 13 wherein the core material is polypropylene.

16. The primary ink storage device of claim 13 wherein the sheath material is polyethylene terephthalate.

17. The primary ink storage device of claim 13 wherein the core material of the at least one individual fiber comprises from 30% to 90% by weight of the at least one individual fiber.

18. The primary ink storage device of claim 12 wherein the network of fibers includes individual fibers that are bonded to each other at points of contact without the use of bonding material.

19. The primary ink storage device of claim 12 wherein the network of fibers are heat fused by an application of heat that softens the network of fibers so that individual fibers of the network of fibers bond at points of contact.

20. The primary ink storage device of claim 12 wherein the network of fibers defines intercommunicating interstitial spaces capable of holding a quantity of said ink.

21. The primary ink storage device of claim 12 wherein each fiber of the network of fibers has a diameter of 12 microns or less.

22. The primary ink storage device of claim 12 wherein the ink reservoir is removable from said system separate from said printhead.

23. The primary ink storage device of claim 12 wherein said network of fibers has a general fiber orientation in a direction parallel to said bottom.

24. A method of providing ink to an ink reservoir for use in an inkjet printing system, the method comprising:

providing an ink reservoir having a network of fibers disposed therein, the network of fibers being heat fused to each other to define intercommunicating interstitial spaces, the reservoir having a rectangular configuration with a height dimension, a width dimension and a length dimension, each of said dimensions greater than one inch, and wherein the ink reservoir when installed into an ink jet printing system has a top and a bottom relative to a gravitational frame of reference, the ink reservoir further including a fluid outlet proximate the bottom of the ink reservoir, and said network of fibers has a general fiber orientation in a direction parallel to said bottom;

providing ink to the ink reservoir;

drawing the ink provided to the ink reservoir into the intercommunicating interstitial spaces by means of capillary action.

25. The method of claim 24 wherein the network of fibers includes individual fibers that are bonded to each other at points of contact without the use of bonding material.

26. The method of claim 24 wherein the network of fibers are heat fused by an application of heat that softens the network of fibers so that individual fibers of the network of fibers bond at points of contact.

27. The method of claim 24 wherein the ink storage device reservoir further includes a fluid outlet proximate the bottom of the ink reservoir.

28. The method of claim 24 wherein the network of fibers with each fiber of the network of fibers having a diameter of 12 microns or less.

29. The method of claim 24, wherein said step of providing an ink reservoir having a network of fibers disposed therein includes:

selecting a fiber diameter of said fibers to set a desired capillary pressure for the inkjet printing system.

30. The method of claim 24 wherein said step of providing an ink reservoir having a network of fibers disposed therein includes:

selecting a fiber material of said fibers which is naturally hydrophilic to said ink.

31. The method of claim 24 further including:

installing the ink reservoir into an inkjet printing system, the inkjet printing system including an inkjet printhead;

establishing fluid connection between the ink reservoir and the inkjet printhead through a fluid conduit free of said fibers; and activating the inkjet printhead to eject ink, the inkjet printhead creating a pressure gradient to draw some of said ink from the network of fibers through the fluid outlet and the fluid conduit to the printhead.

32. The method of claim 31 wherein the step of establishing fluid connection includes connecting the fluid conduit to the fluid outlet.

33. The method of claim 24 wherein the network of fibers including at least one fiber that is a bi-component fiber having a core material and a sheath materials at least partially surrounding the core material with the sheath material different from the core material.

34. The method of claim 33 wherein the sheath material has a higher melting temperature than the core material.

35. The method of claim 33 wherein the core material is polypropylene.

36. The method of claim 33 wherein the sheath material is polyethylene terephthalate.

37. The method of claim 33 wherein the core material of the at least one individual fiber comprises from 30% to 90% by weight of the at least one individual fiber.

38. A method for providing ink from an ink reservoir to an inkjet printhead, the method comprising:

establishing fluid communication between the inkjet printhead and the ink reservoir through a fluid outlet formed in a surface wall of the reservoir and a fluid conduit free of any ink absorbing material;

activating the inkjet printhead to deposit ink on media; and drawing ink from the ink reservoir through the fluid conduit to the inkjet printhead, the ink reservoir having a network of fibers disposed therein, the network of fibers being heat fused to each other to form a rectangular self-sustaining structure and to define intercommunicating interstitial spaces that retain ink by a capillary force, the network of fibers having a general fiber orientation in a direction parallel to said surface wall, wherein the activating step providing a pressure differential that overcomes the capillary force to draw ink from the ink reservoir through the fluid conduit to the inkjet printhead, the network of fibers having a height dimension, a width dimension and a depth dimension, and wherein each of said dimensions is greater than one inch.

39. The method for providing ink from an ink reservoir to an inkjet printhead of claim 38 wherein the network of fibers include individual fibers having fiber having a core of polypropylene and a sheath of polyethylene terephthalate at least partially surrounding the core material.

40. An ink container for providing ink to an inkjet printhead, the inkjet printhead producing a negative gauge pressure within the printhead during release of ink in response to activation by a printer portion, the ink container comprising:

a reservoir for containing ink, the reservoir configured for fluid communication with the inkjet printhead, the reservoir having a rectangular configuration with a height dimension, a width dimension and a length dimension, each of said dimensions greater than one inch; and a network fibers that are individually heat filed at points of contact disposed within the reservoir defining intercommunicating interstitial spaces, the interstitial spaces configured to produce sufficient capillary force to prevent ink leakage from the reservoir during insertion of the reservoir into the printer portion while allowing the negative gauge pressure within the printhead to overcome the capillary force to replenish the printhead with ink from the reservoir the network of fibers having a rectangular cross-sectional configuration to match a rectangular cross-sectional configuration of the reservoir.

41. An ink container for providing ink to an inkjet printhead, the ink container comprising:

a reservoir for containing the ink, the ink container when inserted into a printing system having a top and a bottom relative to a gravitational frame of reference, the ink container further including a fluid outlet proximate the bottom of the ink container for permitting ink flow from the reservoir to the printhead, the reservoir having a rectangular configuration with a height dimension, a width dimension and a length dimension, and wherein each of said dimensions is greater than one inch; and an ink absorbing member disposed in said reservoir for generating a capillary force on the ink in the reservoir, said ink absorbing member including at least one continuous fiber defining a three dimensional porous member with the at least one continuous fiber bonded to itself at points of contact to form a rectangular, self sustaining structure for retaining the ink, wherein ink drawn from the self sustaining structure is provided to the inkjet printhead, said ink absorbing member having a rectangular configuration having a length dimension, a height dimension and a width dimension, each of said dimensions greater than one inch, said ink absorbing member having a general fiber orientation in a direction parallel to said bottom of said reservoir.

42. A method of providing ink to an ink reservoir for use in an inkjet printing system, the method comprising:

providing an ink reservoir having a rectangular, self-sustaining network of fibers disposed therein, the network of fibers having a length dimension, a height dimension and a width dimension, each of said dimensions greater than one inch, said fibers being heat fused to each other to define intercommunicating interstitial spaces, the reservoir having a rectangular configuration with a height dimension, a width dimension and a length dimension, each of said dimensions greater than one inch, and wherein the ink reservoir when installed into an ink jet printing system has a top and a bottom relative to a gravitational frame of reference, the ink reservoir further including a fluid outlet proximate the bottom of the ink reservoir, and said network of fibers has a general fiber orientation in a direction parallel to said bottom;

providing ink to the ink reservoir;

drawing the ink provided to the ink reservoir into the intercommunicating interstitial spaces by means of capillary action.

* * * * *